United States Patent [19]

Setzer et al.

[11] 4,183,771

[45] Jan. 15, 1980

[54] PROCESS FOR MAKING ALUMINUM ALLOY CONDUCTOR WIRE

[75] Inventors: William C. Setzer, Creve Coeur, Mo.; Ronald G. Hardy, Hixson, Tenn.; Joseph Winter, New Haven, Conn.

[73] Assignee: Swiss Aluminium Ltd., Chippis, Switzerland

[21] Appl. No.: 880,415

[22] Filed: Feb. 23, 1978

Related U.S. Application Data

[63] Continuation of Ser. No. 725,430, Sep. 22, 1976, abandoned.

[51] Int. Cl.[2] ..... C22F 1/04

[52] U.S. Cl. ..... 148/2; 75/143; 148/11.5 A; 148/32

[58] Field of Search ..... 148/2, 11.5 A, 32, 32.5; 75/139, 143

[56] References Cited

U.S. PATENT DOCUMENTS 3,763,686 10/1973 Besel et al. ..... 148/11.5 A

*Primary Examiner*—R. Dean

*Attorney, Agent, or Firm*—Robert H. Bachman

[57] ABSTRACT

A process for making aluminum alloy conductor wire having an electrical conductivity of at least 60.0% IACS which involves processing an alloy containing from 0.04 to 1.0% by weight iron, from 0.02 to 0.2% by weight silicon, from 0.1 to 1.0% by weight copper, from 0.001 to 0.2% by weight boron, balance essentially aluminum and processing said alloy without a final redraw step into wire. The process preferably includes hot working from at least approximately 900° F. without reheating to form the redraw rod. This hot working is performed in order to allow the wire produced from this process to meet the desired properties at the final gages, such properties including high electrical conductivity under rapid annealing conditions.

5 Claims, No Drawings operation. This redraw rod is generally furnished as rod having a diameter of from 0.375 to 0.5 inch. Present technology suggests that this rod should possess a temper condition with an ultimate tensile strength in the range of 17 to 22 ksi, a 0.2% offset yield strength in the range of 11 to 16 ksi and a tensile elongation in a 10 inch gage length of 12% minimum. The alloy utilized in the communications wire drawing process should be capable of being drawn down to as fine a gage as possible in order to provide a wide range of wire sizes.

Preferred attributes of the wire utilized in the present invention should include reproducibility in the chemical composition of the alloy, an electrical conductivity in the finished wire of at least 60.0% IACS, a low strain hardening rate and an ability to control yield strength in the finished wire without a redraw operation after annealing.

Accordingly, it is a principal object of the present invention to provide an improved process for making aluminum alloy conductor wire.

It is a further object of the present invention to provide an improved process as above which does not require a redraw step after initial drawing and annealing of the wire in order to meet communications wire specifications.

It is another object of the present invention to provide an improved process as above which produces wire which possesses high strength, high electrical conductivity, excellent formability, processability and excellent stress relaxation resistance.

An additional object of the present invention is to provide a process as above which satisfies the foregoing objectives with a combination of high productivity and reasonable cost.

Other objects and advantages of the present invention will become more apparent from a consideration of the following detailed description.

DETAILED DESCRIPTION

It is important to realize that what is desired in the wire produced by the present invention is not only a combination of high strength with high electrical conductivity but also excellent ductility, reduced annealing requirements and good connection characteristics in the finished wire. Generally, processing which accomplishes an increase in strength and conductivity of wire tends to decrease the ductility of the improved product. Therefore, it is surprising that a combination of all the above-mentioned properties can be achieved in the alloy system processed according to the present invention.

The aluminum alloys utilized in the present invention may be prepared and cast in a conventional manner. The cast metal should be passed through at least one filtering medium before further processing to remove any undesirable particles in the metal which may affect the final strength or conductivity of the wire produced from said metal. Additional elements may be added to the alloy melt such as magnesium, zirconium, manganese, chromium or other elements to improve the strength or thermal stability of the wire produced from the alloy. Care should be taken in selecting and adding these elements, however, since they may adversely affect the electrical conductivity and ductility of the wire if added in relatively large amounts to the alloy. Titanium may be added, if desired, to the alloy to provide grain refinement in the cast material. This element may be added to the alloy in amounts less than the stoichiometric quantity necessary to form $TiB_2$ in the alloy. Conventional impurities associated with the aluminum base may also be present in the alloy but only in amounts small enough so as to not materially affect the electrical conductivity of any wire produced from the alloy. The as-cast billet or bar produced from the casting operation may be homogenized, if desired, at 890°–970° F. for eight hours or more.

The billet is hot rolled at which is a fairly high starting temperature of at least approximately 900° F. This high temperature hot rolling procedure is performed mainly to increase the electrical conductivity values of the finished wire ultimately produced from the cast billet. This hot rolling is performed from approximately 900° F. without reheating to form a redraw rod having a nominal diameter of 0.375 to 0.5 inch.

This redraw rod must conform to minimum industrial specifications as set forth hereinabove. The rod is passed through a series of dies to form various size wires, depending upon the desired use for each size wire. A large enough series of wire dies is utilized to provide any desired gage of wire down to as fine as may be practically produced. The wire may be drawn down to a diameter of between 0.002 and 0.5 inch, depending upon the final desired use of the wire. The drawn wire may be directed to various work stations which may either strand, twist or coat each wire, or any combination of each working step, before being wound onto drums for further use.

The present invention will be more readily apparent from a consideration of the following illustrative example.

EXAMPLE I

An aluminum base alloy containing 0.6 percent iron, 0.22 percent copper (hereinafter known as S) was cast at approximately 1250°–1300° F. The molten alloy was formed into a billet having dimensions of approximately 2×2×7 inches. This billet was then hot rolled from 900° F. without reheating to a 0.375 inch redraw rod. The rod was drawn down to 24 AWG gage (0.0201 inch). The wire was then resistance annealed for 0.3 seconds using an annealing current of 320 amperes at a line speed of 3500 fpm.

This wire was compared with various other commercially available wires used in the communications wire industry, including AA Alloy 1350 (EC), an alloy containing 0.6% Fe and 0.075% Mg (A), an alloy containing 0.7% Fe and 0.2% Mg (B), an alloy containing 0.8% Fe with 0.15% Mg (C), an alloy containing 0.2% Fe with 0.1% Mg and 0.4% Cu (D), an alloy containing 0.3% Fe and 0.35% Mg (E) and finally an alloy containing 0.8% Fe and 0.2% Mg (F). Properties which were compared were yield strength, ultimate tensile strength, percent elongation in 10 inches, electrical conductivity and number of 180° bending cycles. These property comparisons are presented in Table I.

TABLE I

Comparative Physical Property Data for 24 AWG Gage Wires

| Wire | 0.2% Yield Strength psi | Ultimate Tensile Strength psi | % Elong. in 10 inches | Electrical Conductivity Percent IACS | 180° Free Loop Bends | Pass or Fail |
|---|---|---|---|---|---|---|
| A | 19,700 | 21,500 | 5.7 | 61.2 | 24 | Pass |
| B | 20,600 | 23,500 | 4.8 | 59.8 | 25 | Fail |
| C | 30,800 | 32,400 | 1.0 | 59.3 | 5 | Fail |
| D | 27,200 | 29,200 | 1.4 | 59.4 | 7 | Fail |

PROCESS FOR MAKING ALUMINUM ALLOY CONDUCTOR WIRE

This is a continuation of application Ser. No. 725,430, filed Sept. 22, 1976, abandoned.

BACKGROUND OF THE INVENTION

The present invention relates to a process for making an aluminum alloy conductor wire for use in building wire or telephone and telecommunications wire applications.

Copper has been used extensively as the metal in building and communications wire. Aluminum alloys have recently been provided to building and communications wire manufacturers in order to provide wire having weight and economical advantages over copper wire but most of the conductive advantages of copper. This reduction in weight is very desirable because of the distances over which communications wire must be employed and also because of the large number of wires needed in both building and communications wire installations, particularly in large buildings. It is desirable to reduce the weight of such installations, especially considering transportation problems and labor efficiency with heavy wire. Pure aluminum and aluminum alloys, made into wire, as previously proposed, have exhibited disadvantages which tend to restrict the usefulness of such wire for building and communications wire applications. These disadvantages include a lower conductivity than pure copper, processing difficulties, low strength and the tendency for the pure aluminum wire in various connection devices to exhibit stress relaxation. This last disadvantage presents perhaps the most concern regarding the use of dilute aluminum base alloys and pure aluminum in building and communications installations.

It is known that stress relaxation allows a wire to reduce the stress level in time at which the wire is initially installed. Under normal cyclical operating conditions, this undesirable property tends to allow an increase in contact resistance at the connection, thus causing a potentially unsafe condition. Therefore, it is desirable that the resistance of aluminum alloy wire to this stress relaxation phenomenon under either tensile or compressive loading should be quite high since the stability of the entire building or communications installation depends upon continued high conductivity and continuous operative connections.

To be competitive, aluminum alloy wires must also exhibit good strength properties and high ductility. For example, aluminum alloy wire should be capable of meeting minimum communications industrial requirements such as a yield strength of 14 ksi, an ultimate tensile strength of 19 ksi, an elongation of at least 2.5%, a capability of being bent through 180° at least 15 times and a minimum IACS conductivity of 60%. In addition, there should be minimal breaks in the aluminum alloy wire during processing of a 300 lb. sample using standard aluminum wire drawing practices. These requirements for the aluminum alloy wire are all necessary to provide a communications wire which can be pair twisted, then stranded into a multiple strand communications cable, insulated in an extrusion process, and finally reeled and unreeled both before and during installation without breakage of any individual wires. An aluminum alloy wire which meets the above requirements also provides an economical alternative to copper wire. Such an aluminum alloy wire provides a material which can exhibit a high freedom from breakage during drawing and thus a high total production volume. The total production volume is a direct function of the drawing speed and thus freedom from breakage is important as up to an hour may be required to string up a drawing machine if a break occurs, resulting in lost production capacity. It is important to keep the break frequency of the wire down in addition to providing a material which is capable of providing high drawing speeds. This wire should also have sufficient ductility to allow for field installations without wiring breakage.

The major aluminum conductor material which has been used in building and communications wire is Aluminum Association Alloy 1350 or what has more commonly been known as EC aluminum. This material, which contains at least 99.50% by weight pure aluminum, does not satisfy all of the property requirements described above. While AA Alloy 1350 does provide an electrical conductivity of at least 61% IACS, generally desirable percent elongation values have been obtained for AA Alloy 1350 wire only at less than desirable tensile strengths in the wire. Various aluminum alloys have been utilized as alternatives to AA Alloy 1350 but generally do not provide electrical conductivity values as high as the AA Alloy 1350.

SUMMARY OF THE INVENTION

The present invention provides a process for making improved aluminum alloy conductor wire useful in building and communications wire applications. The aluminum alloy wire has a diameter between 0.002 and 0.500 inch and contains from 0.04 to 1.0% by weight iron, from 0.02 to 0.2% by weight silicon, from 0.1 to 1.0% by weight copper, from 0.001 to 0.2% by weight boron, balance essentially aluminum. This aluminum alloy is taught in U.S. Pat. Nos. 3,711,339 and 3,763,686, by F. A. Besel and W. C. Setzer, the disclosures of which are incorporated herein by reference.

Major industrial suppliers of communications wire have traditionally depended upon one wire drawing process for aluminum and aluminum alloys and another different wire drawing process for copper and copper alloys. The former drawing process has generally involved a drawing step followed by an annealing step which in turn is followed by a redraw step. The latter process has generally involved a drawing step followed by either a full or partial anneal step with no redraw step. Obviously, the latter process is a more economical way to make communications wire in particular since it eliminates a processing step and the attendant synchronization problems inherent with a draw-anneal-redraw process. The process of the present invention also minimizes the amount of expensive inert gas which is required with the draw-anneal-redraw process. The alloy utilized in the present invention was developed not only to provide improved mechanical and electrical properties over other aluminum alloy materials but also to provide an aluminum alloy which could be used in the drawing process formerly reserved for copper and copper alloys.

The major industrial suppliers of communications wire, for example, have prepared material specifications which proposed alloys have to meet in order to become commercially viable components of communications wire. These specifications generally apply to what is termed redraw rod, which is usually a continuously cast and rolled rod of metal used in a subsequent drawing TABLE I-continued Comparative Physical Property Data for 24 AWG Gage Wires

| Wire | 0.2% Yield Strength psi | Ultimate Tensile Strength psi | % Elong. in 10 inches | Electrical Conductivity Percent IACS | 180° Free Loop Bends | Pass or Fail |
|---|---|---|---|---|---|---|
| E | 22,500 | 24,900 | 1.9 | 59.1 | 12 | Fail |
| F | 27,800 | 30,000 | 1.3 | 58.6 | 8 | Fail |
| EC | 17,700 | 18,500 | 1.6 | 62.4 | 25 | Fail |
| S | 14,400 | 20,800 | 13.2 | 61.0 | 134 | Pass |
| Communications Industry Minimums: | | | | | | |
| | 14,000 | 19,000 | 2.5 | 60.0 | 15 | |

As can be seen from Table I, only one commercial alloy wire (A) is able to pass the industrial minimum property requirements. While this wire has a higher yield strength, ultimate tensile strength and electrical conductivity than does the wire formed from the present invention (S), it should be noted that Wire S has far greater ductility, as expressed by the number of 180° bends, than does Wire A. Wire S also has a far greater percentage elongation than does Wire A.

In determining whether or not each wire received a pass or fail, it was necessary that each wire meet or exceed each minimum requirement specified at the end of Table I. Thus, a wire which possessed high strength, elongation and ductility would fail because of an electrical conductivity value below 60.0% IACS.

Resistance of a wire to the 180° free loop bend test is very important in determining further processability of the aluminum alloy wire. Since wires formed from aluminum or aluminum alloys have in the past failed at connection points, the ability of such a wire to withstand bending around a connection device is of very high importance. The overwhelming superiority of the wire formed from the present invention, as demonstrated by a bending failure resistance at least five times greater than any other tested wire, is evidence of the usefulness of Wire S for communications wire purposes.

In determining the final gage of each wire, micrometer measurements of the diameter of each wire were made using a restricted variation of 0.0003 inch. Only the smallest measured diameters for each wire were used in calculating their offset yield and ultimate tensile strengths. These strength measurements were determined by gripping 10 inch long wire samples in a machine with a crosshead speed of 0.2 inch/minute. A strain gate was not used to determine the offset yield strength because of the small diameters of the wire. The ratio between the machine crosshead speed and the recording chart speed was used instead to determine the yield strength at 0.2% offset. This procedure is commonly used when use of a strain gage is undesirable or difficult.

The aluminum alloy wire formed from the present invention clearly demonstrates its superiority to AA Alloy 1350 wire and various industrial aluminum alloy wires in the important areas of elongation and ability to undergo numerous bending cycles, both requirements which are very important to communications wire installations. The electrical conductivity value is also higher than almost all competing aluminum alloy wires and just slightly lower than the recognized conductivity industry leader, AA Alloy 1350.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the maining and range of equivalency are intended to be embraced therein.

What is claimed is:

1. A process for making aluminum alloy conductor wire consisting essentially of the steps:

(a) providing an aluminum alloy consisting essentially of from 0.04 to 1.0% by weight iron, from 0.02 to 0.2% by weight silicon, from 0.1 to 1.0% by weight copper, from 0.001 to 0.2% by weight boron, balance aluminum;

(b) casting and filtering said alloy into billet or bar form;

(c) deforming said billet or bar to form redraw rod without reheating at a starting temperature of at least approximately 900° F.; p1 (d) cold deforming said redraw rod to final gage at a diameter of between 0.002 and 0.5 inch; and (e) finally annealing said cold deformed rod at final gage for a period of time and at a temperature sufficient to form wire having an electrical conductivity of at least 60% IACS in addition to a combination of high strength, excellent ductility and good connection characteristics.

2. A process according to claim 1 wherein said deforming step (c) produces redraw rod having a nominal diameter between 0.375 and 0.5 inch.

3. A process according to claim 1 wherein said annealing step (e) is a resistance annealing step.

4. A process according to claim 1 wherein a small but effective amount of an element selected from the group consisting of magnesium, zirconium, manganese, chromium, titanium, and mixtures thereof is added to said alloy of step (a).

5. The aluminum alloy conductor wire produced from the process of claim 1.

* * * * *

UNITED STATES PATENT AND TRADEMARK OFFICE

CERTIFICATE OF CORRECTION

PATENT NO. : 4,183,771

DATED : January 15, 1980

INVENTOR(S) : William C. Setzer, Ronald G. Hardy and Joseph Winter

It is certified that error appears in the above-identified patent and that said Letters Patent are hereby corrected as shown below:

Column 4, line 9, change "which" to read ---what---.

Column 5, line 50, change "gate" to read ---gage---.

Column 6, line 33, claim 1, after "900°F.;" delete "pl" and start section "(d)" as a new paragraph.

Signed and Sealed this

*Twentieth* Day of *May 1980*

[SEAL]

*Attest:*

SIDNEY A. DIAMOND

*Attesting Officer*

*Commissioner of Patents and Trademarks*